US012203173B2

(12) United States Patent
Ceglarek et al.

(10) Patent No.: US 12,203,173 B2
(45) Date of Patent: Jan. 21, 2025

(54) ALTERNATIVE COMPOSITION AND ALTERNATIVE METHOD FOR EFFECTIVELY PHOSPHATING METAL SURFACES

(71) Applicant: Chemetall GmbH, Frankfurt (DE)

(72) Inventors: Timo Christoph Ceglarek, Frankfurt am Main (DE); Hardy Wietzoreck, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 792 days.

(21) Appl. No.: 17/425,042

(22) PCT Filed: Jan. 23, 2020

(86) PCT No.: PCT/EP2020/051585
§ 371 (c)(1),
(2) Date: Jul. 22, 2021

(87) PCT Pub. No.: WO2020/156913
PCT Pub. Date: Aug. 6, 2020

(65) Prior Publication Data

US 2022/0119957 A1 Apr. 21, 2022

(30) Foreign Application Priority Data

Jan. 29, 2019 (EP) ..... 19154196

(51) Int. Cl.

| | |
|---|---|
| ***C23C 22/12*** | (2006.01) |
| ***C23C 22/18*** | (2006.01) |
| ***C23C 22/36*** | (2006.01) |
| ***C23C 22/82*** | (2006.01) |
| *C23C 22/07* | (2006.01) |

(52) U.S. Cl.
CPC ..... *C23C 22/365* (2013.01); *C23C 22/82* (2013.01)

(58) Field of Classification Search
CPC ..... C23C 22/07–20
See application file for complete search history.

(56) References Cited

U.S. PATENT DOCUMENTS 4,470,853 A * 9/1984 Das ..... C23C 22/362 148/247

FOREIGN PATENT DOCUMENTS

DE 102016205815 A1 10/2016
WO 9730189 A1 8/1997

OTHER PUBLICATIONS

International Search Report for corresponding PCT/EP2020/051585 mailed Mar. 27, 2020, 2 Pages.
European Search Report for EP Patent Application No. 19154196.0, Issued on Jul. 8, 2019, 3 pages.

* cited by examiner

*Primary Examiner* — Lois L Zheng
(74) *Attorney, Agent, or Firm* — Armstrong Teasdale LLP

(57) ABSTRACT

Described herein is an alternative acidic, aqueous composition for effectively phosphating metallic surfaces, which includes, besides zinc ions, manganese ions, phosphate ions and, preferably, nickel ions, at least one accelerator of a formula $R_1R_2R_3C—NO_2$ where each of the substituents $R_1$, $R_2$ and $R_3$ on the carbon atom is selected, independently of the others, from the group consisting of hydroxymethyl, 1-hydroxyethyl, 2-hydroxyethyl, 1-hydroxypropyl, 2-hydroxypropyl, 3-hydroxypropyl, 1-hydroxy-1-methylethyl and 2-hydroxy-1-methylethyl. Also described herein are a method for producing such a composition, an alternative method for phosphating metallic surfaces, and a method of using phosphate coatings produced accordingly.

20 Claims, No Drawings

ALTERNATIVE COMPOSITION AND ALTERNATIVE METHOD FOR EFFECTIVELY PHOSPHATING METAL SURFACES

CROSS-REFERENCE TO RELATED APPLICATIONS

This application is a U.S. National Phase Application of International Patent Application No. PCT/EP2020/051585, filed Jan. 23, 2020, which claims priority to European Patent Application No. 19154196.0, filed Jan. 29, 2019, the entire contents of which are hereby incorporated by reference herein.

FIELD OF INVENTION

The present invention relates to an alternative composition for effectively phosphating metallic surfaces, to a method for producing such a composition, to an alternative method for phosphating metallic surfaces, and to the use of phosphate coatings produced accordingly.

BACKGROUND

Phosphate coatings on metallic surfaces are known from the prior art. Such coatings serve for corrosion control of the metallic surfaces and also, furthermore, as adhesion promoters for subsequent coating films or as a forming aid.

These coatings are also referred to as conversion coats, since cations leached from the metallic surface are included in the coat structure.

Such phosphate coatings are employed in particular in the sector of the automobile industry and also of general industry. The subsequent coating films, as well as powder coatings and wet paints, are, in particular, cathodically deposited electrocoat (CEC) materials.

Phosphate coatings are, however, also used as a forming aid beneath a subsequently applied lubricant layer for cold forming, or as protection for a short storage time before coating.

The protons in the acidic phosphating bath cause oxidative pickling of metal cations out of the metallic surface. The protons are simultaneously reduced to hydrogen, causing a pH gradient to form toward the metallic surface. The elevated surface pH is key to the deposition of the phosphate layer there.

Phosphating baths customarily employ what are called accelerators, which are added to the baths in the form of liquid additives. These accelerators assist the deposition of the phosphate layer by oxidatively removing the hydrogen formed at the metallic surface from the equilibrium and so promoting the development of the pH gradient.

One such accelerator that is particularly effective is nitroguanidine. This compound does, though, have a few drawbacks:

1) Because the storage of the raw material at below 20 wt % water content presents problems, it is classified as explosive.
2) Producing an aqueous nitroguanidine-comprising additive is complicated by the low water solubility. A suspension has to be prepared first using stabilizers.
3) Lastly, the shelf life of the additive is limited, and addition of a biocide is a must.

It was an object of the present invention, therefore, to provide an alternative composition and alternative method with which metallic surfaces, more particularly not only those made of zinc but also aluminum and optionally iron surfaces, could be effectively phosphated, especially while avoiding the aforesaid drawbacks of nitroguanidine as an accelerator and achieving film adhesion and corrosion control outcomes comparable with those of phosphating using nitroguanidine.

DESCRIPTION

This object is achieved by means of an acidic, aqueous composition of the invention for phosphating metallic surfaces, which comprises, besides zinc ions, manganese ions, phosphate ions and, preferably, nickel ions, at least one accelerator of the formula (I) below $$R_1R_2R_3C—NO_2 \quad (I)$$

where each of the substituents $R_1$, $R_2$ and $R_3$ on the carbon atom is selected, independently of the others, from the group consisting of hydroxymethyl, 1-hydroxyethyl, 2-hydroxyethyl, 1-hydroxypropyl, 2-hydroxypropyl, 3-hydroxypropyl, 1-hydroxy-1-methylethyl and 2-hydroxy-1-methylethyl.

Said object is further achieved by means of a method of the invention for phosphating a metallic surface, wherein a metallic surface, optionally after cleaning and/or activation, is treated with the composition of the invention and thereafter optionally rinsed and/or dried.

Definitions

The method of the invention can be used to treat either an uncoated metallic surface or else a metallic surface which has already been conversion coated, having undergone preliminary phosphating, for example. Reference below to a "metallic surface" is therefore always to be taken as also including an already conversion-coated metallic surface.

An "aqueous composition" for the purposes of the present invention is a composition which comprises at least partly, preferably predominantly, i.e., to an extent of more than 50 wt %, water as its solvent/dispersion medium. As well as dissolved constituents it may also comprise dispersed, i.e., emulsified and/or suspended, constituents. The same applies to an "aqueous additive".

Reference presently to a "phosphating bath composition" is to an acidic, aqueous composition for the phosphating of metallic surfaces.

For the purposes of the present invention, "phosphate ions" also refers to hydrogen phosphate, dihydrogen phosphate and phosphoric acid. Moreover, the intention is to include pyrophosphoric acid and polyphosphoric acid and all of their partially and fully deprotonated forms.

According to the invention, "aluminum" is understood to include alloys thereof. At the same time, "zinc" according to the invention also comprises zinc alloys, for example zinc-magnesium alloys, and also galvanized steel and alloy-galvanized steel, while the stating of "iron" also includes iron alloys, especially steel. The galvanized steel or alloy-galvanized steel may in turn comprise hot-dip galvanized or electrolytically galvanized steel. Alloys of the aforementioned metals have an extraneous atom content of less than 50 wt %.

The composition/method of the invention is especially suitable for multimetal applications. In particular, therefore, the treated metallic surface is a surface that, besides regions made of zinc, also comprises regions made of aluminum and optionally regions made of iron.

In the method of the invention it is advantageous first to clean and especially to degrease the metallic surface in an aqueous cleaning composition prior to the treatment with the composition of the invention. For this purpose it is especially possible to use an acidic, neutral, alkaline or strongly alkaline cleaning composition, but optionally also additionally an acidic or neutral pickling composition.

An alkaline or strongly alkaline cleaning composition has been found here to be especially advantageous.

The aqueous cleaning composition may, besides least one surfactant, optionally also comprise a detergent builder, as for example a water-soluble silicate, and/or other additions, as for example complexing agents, phosphates and/or borates. It is also possible to use an activating detergent.

After the cleaning/pickling, the metallic surface is then advantageously at least rinsed with water, in which case the water may optionally have been admixed as well with a water-dissolved additive such as a nitrite or surfactant, for example.

Before the treatment of the metallic surface with the composition of the invention, it is advantageous to treat the metallic surface with an aqueous activating composition. The purpose of the activating composition is to deposit a large number of ultrafine phosphate particles as seed crystals on the metallic surface. In the subsequent method step, in contact with the composition of the invention—preferably without rinsing in between—these crystals help to form a phosphate layer, more particularly a crystalline phosphate layer, having an extremely high number of densely disposed, fine phosphate crystals, or a largely impervious phosphate layer.

Activating compositions contemplated in this case include, in particular, alkaline compositions based on titanium phosphate and/or zinc phosphate.

It may, however, also be advantageous to add activating agents, especially titanium phosphate and/or zinc phosphate, to the cleaning composition—in other words, to carry out cleaning and activation in one step.

In one preferred embodiment, the acidic, aqueous composition of the invention for phosphating metallic surfaces comprises, besides zinc ions, manganese ions, phosphate ions and, preferably, nickel ions, at least one accelerator of the formula (II) below $$[OH—(CH_2)_n—]_3C—NO_2 \quad (II)$$

where for each of the 3 $OH—(CH_2)_n—$ groups, independently of the others, n=1 to 3.

This at least one accelerator of the formula (II) preferably comprises at least one compound in which, for all 3 $OH—(CH_2)_n—$ groups, n=1, n=2 or n=3. More preferably it comprises at least one compound in which, for all 3 $OH—(CH_2)_n—$ groups, n=1 or n=2, and very preferably it comprises 2-hydroxymethyl-2-nitro-1,3-propanediol (n=1). Especially preferably the at least one accelerator of the formula (II) is 2-hydroxymethyl-2-nitro-1,3-propanediol.

The at least one accelerator of the formula (I)—especially of the formula (II)—is present preferably at a concentration which is in the range from 0.25 to 4.0 g/l, more preferably from 0.50 to 3.3 g/l and very preferably from 0.75 to 2.5 g/l—calculated as 2-hydroxymethyl-2-nitro-1,3-propanediol. "Calculated as 2-hydroxymethyl-2-nitro-1,3-propanediol" is understood as implying that all the molecules of the at least one accelerator are 2-hydroxymethyl-2-nitro-1,3-propanediol.

Accelerators of the formula (I)—especially of the formula (II)—have advantages, especially over the accelerator nitroguanidine, as follows:

1) They are not classed as explosive. Storage of the raw material even at a water content below 20 wt % is thus unproblematic.
2) Producing an aqueous, accelerator-comprising additive is simple by virtue of the good water solubility (up to 50 wt %). The accelerators are directly soluble in water. There is therefore no need for a suspension to be prepared first using stabilizers.
3) Lastly, the shelf life of the additive is long, with no need to add a biocide.

A phosphating bath composition of the invention, which therefore comprises at least one accelerator of the formula (I)—especially of the formula (II)—additionally shows comparable accelerator stability in respect of decomposition without treatment of metal surfaces to a phosphating bath composition that comprises nitroguanidine.

Compared with metallic surfaces treated with a phosphating bath composition that comprises nitroguanidine, those treated with the phosphating bath composition of the invention and then coated exhibit comparable or even better film adhesion and also comparable or even better corrosion control (against corrosive undermining).

The latter is also true of comparison between the phosphating bath composition of the invention and a phosphating bath composition that comprises nitrite. Moreover, the phosphating bath composition of the invention features appreciably greater accelerator stability than one comprising nitrite, which is a hazardous substance.

In one preferred embodiment, the phosphating composition of the invention preferably comprises the following components in the following preferred and more preferred concentration ranges:

| | | |
|---|---|---|
| Zn | 0.3 to 3.0 g/l | 0.5 to 2.0 g/l |
| Mn | 0.3 to 2.0 g/l | 0.5 to 1.5 g/l |
| Ni | 0.3 to 2.0 g/l | 0.5 to 1.5 g/l |
| phosphate (calculated as P) | 3.5 to 10.9 g/l | 4.3 to 7.8 g/l |

Since the deposition of CEC requires a flow of current between metallic surface and treatment bath, it is important to set a defined electrical conductivity in the phosphate coating in order to ensure efficient and uniform deposition.

Phosphate coatings, therefore, are customarily applied using a nickel-containing phosphating solution. The nickel deposited in this process, elementally or as an alloy constituent, e.g. Zn/Ni, provides the coating with appropriate conductivity in the subsequent electrocoating procedure.

For treating metallic surfaces also comprising zinc-containing, especially hot-dip galvanized, regions, the presence of at least one complex fluoride in the composition of the invention has additionally proven advantageous.

The reason is that adding complex fluorides successfully suppresses the tendency to form nibs. These nibs are little pickling pits with an edge accumulation of zinc phosphate crystals (cf. W. Rausch, "Die Phosphatierung von Metallen", Eugen G. Leuze Verlag, 2nd edition, 1988, chapter 3.1.5, p. 108).

The at least one complex fluoride preferably is tetrafluoroborate ($BF_4^-$) and/or hexafluorosilicate ($SiF_6^{2-}$), the content of complex fluoride in the composition of the invention being preferably in the range from 0.5 to 5 g/l, more preferably from 0.5 to 3 g/l.

For treating metallic surfaces comprising both zinc-containing and aluminum-containing regions, the presence of free fluoride as well as of complex fluoride in the composition of the invention has additionally proven advantageous, especially in the aforesaid regions.

The free fluoride content in this case is preferably in the range from 20 to 250 mg/l, more preferably from 30 to 180 mg/l, can be determined using a fluoride-sensitive electrode, and is added to the composition of the invention in particular as simple fluoride, i.e., not as complex fluoride. Simple fluorides contemplated include, in particular, hydrofluoric acid, sodium fluoride, sodium bifluoride and also ammonium bifluoride.

$Al^{3+}$ in phosphating bath systems is a bath poison and can be restricted by addition of sodium ions and also of simple fluoride, i.e., brought to a concentration of below 100 mg/l, preferably below 50 mg/l and more preferably below 25 mg/l. Preference here is given to precipitating cryolite ($Na_3AlF_6$), which has very low solubility in water. A sodium content in the range from 1.0 to 4.0 g/l, preferably from 1.7 to 3.5 g/l, is advantageous in this respect.

Because of the fluoride buffering effect of complex fluorides it is possible, in the case of a briefly increased throughput of aluminum-containing metallic surfaces, through intensified release of free fluoride from the complex, to absorb a reduction in the free fluoride content of the phosphating bath without having to adapt the bath by adding simple fluoride in each individual event.

The free fluoride not least promotes the pickling attack on the metallic surface and hence the formation there of the phosphate layer, leading in turn to improvements in film adhesion and corrosion control—and not just on metallic surfaces comprising zinc or aluminum.

One possible embodiment matches the above-described preferred embodiment but for the difference that the composition of the invention is essentially nickel-free (nickel-free phosphating).

"Essentially nickel-free" here means that the nickel ion content is not a result of a deliberate addition to the composition of the invention. Thus it is possible, for example, that an amount—albeit small—of nickel ions is leached out of the metallic surface. In this event, though, the nickel ion content is preferably just 10 mg/l at most, more preferably at most 1 mg/l.

On account of their high toxicity and environmental harmfulness, nickel ions are no longer a desirable constituent of treatment solutions, and ought therefore as far as possible to be avoided or at least reduced in their amount.

In one preferred embodiment, the composition of the invention comprises besides the at least one accelerator of the formula (I)—especially of the formula (II)—hydrogen peroxide ($H_2O_2$) as further accelerator. In that event said peroxide is present preferably at a concentration in the range from 10 to 100 mg/l, more preferably from 15 to 50 mg/l.

Where the surface for treatment also includes iron-containing regions, especially steel, the use of $H_2O_2$ as further accelerator allows an accumulation of Fe(II) in the phosphating bath composition and hence retardation of coat-forming to be avoided: $H_2O_2$ oxidizes Fe(II) to Fe(III), which precipitates as iron(III) phosphate.

The composition of the invention is preferably essentially free of nitroguanidine, meaning that no nitroguanidine has been deliberately added to the composition. If said composition nevertheless comprises nitroguanidine, the latter is present merely as an impurity, i.e., in low or very low quantities. The nitroguanidine concentration in this case is preferably below 10 mg/l, more preferably below 1 mg/l.

The composition of the invention may be characterized, furthermore, by the following preferred and more preferred parameter ranges:

| | | |
|---|---|---|
| FA or FA-KCl | 0.3 to 2.5 | 0.7 to 1.6 |
| FA (dil.) | 0.5 to 8 | 1 to 6 |
| FTA | 10 to 28 | 14 to 26 |
| TA or TA-KCl | 12 to 45 | 18 to 35 |
| A value | 0.01 to 0.2 | 0.03 to 0.15 |
| Temperature | 30 to 58° C. | 35 to 55° C. |

"FA" here stands for free acid or—where complex fluorides are present in the phosphating bath—free acid-KCl, "FA (dil.)" for free acid (diluted), "FTA" for Fischer total acid, "TA" for total acid or—where complex fluorides are present in the phosphating bath—total acid-KCl, and "A value" for acid value.

Determining these parameters is carried out as part of the analytic checking of the phosphating chemicals and serves for ongoing monitoring of the working phosphating bath (cf. W. Rausch "Die Phosphatierung von Metallen", Eugen G. Leuze Verlag, 3rd edition, 2005, chapter 8, p. 332 ff.):

Free Acid (FA) or Free Acid-KCl (FA-KCl):

(cf. W. Rausch "Die Phosphatierung von Metallen", Eugen G. Leuze Verlag, 3rd edition, 2005, chapter 8.1, pp. 333-334)

For determination of the free acid or—where complex fluorides are present in the phosphating bath—of the free acid-KCl, 10 ml of the composition of the invention is pipetted into a suitable vessel, such as a 300 ml conical flask, and diluted with 50 ml of deionized water. Where the composition of the invention comprises complex fluorides, the sample is instead diluted with 50 ml of 2 M KCl solution. Titration then takes place, using a pH meter and an electrode, with 0.1 M NaOH to a pH of 4.0. The quantity of 0.1 M NaOH consumed in this titration, in ml per 10 ml of the composition, gives the value of the free acid (FA) or of the free acid-KCl (FA-KCl) in points.

Free Acid (Diluted) (FA (Dil.)):

(cf. W. Rausch "Die Phosphatierung von Metallen", Eugen G. Leuze Verlag, 3rd edition, 2005, chapter 8.1, pp. 333-334)

For determination of the free acid (diluted), 10 ml of the composition of the invention is pipetted into a suitable vessel, such as a 300 ml conical flask. 150 ml of deionized water is then added. Using a pH meter and an electrode, titration takes place with 0.1 M NaOH to a pH of 4.2. The quantity of 0.1 M NaOH consumed in this titration, in ml per 10 ml of the diluted composition, gives the value of the free acid (diluted) (FA (dil.)) in points.

Fischer Total Acid (FTA):

(cf. W. Rausch "Die Phosphatierung von Metallen", Eugen G. Leuze Verlag, 3rd edition, 2005, chapter 8.2, pp. 334-336)

Following determination of the free acid (diluted), the diluted composition of the invention, after addition of potassium oxalate solution, is titrated, using a pH meter and an electrode, with 0.1 M NaOH to a pH of 8.9. The consumption of 0.1 M NaOH in ml per 10 ml of the diluted composition gives here the Fischer total acid (FTA) in points.

Total Acid (TA) or Total Acid-KCl (TA-KCl):

(cf. W. Rausch "Die Phosphatierung von Metallen", Eugen G. Leuze Verlag, 3rd edition, 2005, chapter 8.3, pp. 336-338)

The total acid or—where complex fluorides are present in the phosphating bath—total acid-KCl is the sum of the divalent cations present and also free and bonded phosphoric acids (the latter being phosphates). It is determined by the consumption of 0.1 M NaOH using a pH meter and an electrode. For this purpose, 10 ml of the composition of the invention is pipetted into a suitable vessel, such as a 300 ml conical flask, and diluted with 50 ml of deionized water. Where the composition of the invention comprises complex fluorides, the sample is instead diluted with 50 ml of 2 M KCl solution. This is followed by titration with 0.1 M NaOH to a pH of 8.9. The consumption in ml per 10 ml of the diluted composition corresponds here to the points number of the total acid (TA) or of total acid-KCl (TA-KCl).

Acid Value (A Value):

(cf. W. Rausch "Die Phosphatierung von Metallen", Eugen G. Leuze Verlag, 3rd edition, 2005, chapter 8.4, p. 338)

The acid value (A value) represents the ratio FA:FTA or FA-KCl:FTA and is obtained by dividing the value for the free acid (FA) or for the free acid-KCl (FA-KCl) by the value for the Fischer total acid (FTA).

The metallic surface is treated with the composition of the invention preferably for 30 to 480, more preferably for 60 to 300 and very preferably for 90 to 240 seconds, preferably by means of dipping or spraying.

The treatment of the metallic surface with the composition of the invention produces the following preferred and more preferred zinc phosphate coat weights on the metallic surface, depending on the surface treated (determined by x-ray fluorescence analysis (XRF)):

| Surface treated | Zinc phosphate coat weight ($g/m^2$)* | |
|---|---|---|
| Steel | 0.5 to 6 | 1.0 to 5 |
| Hot-dip galvanized | 0.5 to 6 | 1.0 to 5 |
| Electrolytically galvanized | 0.5 to 6 | 1.0 to 5 |
| Aluminum | 0.5 to 6 | 1.0 to 5 |

*calculated as $Zn_3(PO_4)_2 \cdot 4H_2O$

A further subject of the present invention is a method for producing the composition of the invention, by i) first producing an aqueous additive which comprises 1 to 50 wt % of at least one accelerator of the formula (I) below $$R_1R_2R_3C—NO_2 \quad (I)$$

where each of the substituents $R_1$, $R_2$ and $R_3$ on the carbon atom is selected, independently of the others, from the group consisting of hydroxymethyl, 1-hydroxyethyl, 2-hydroxyethyl, 1-hydroxypropyl, 2-hydroxypropyl, 3-hydroxypropyl, 1-hydroxy-1-methylethyl and 2-hydroxy-1-methylethyl, and ii) then adding this additive to a phosphating bath composition which comprises zinc ions, manganese ions, phosphate ions and also, preferably, nickel ions, the aqueous additive being produced by dissolving the at least one accelerator directly in water, preferably in deionized water, and not first producing a suspension using stabilizers, and also preferably adding no biocide.

In step ii) the additive is here diluted preferably such that in the phosphating bath composition the at least one accelerator of the formula (I)—especially of the formula (II)—is present at a concentration which is in the range from 0.25 to 4.0 g/l, more preferably from 0.50 to 3.3 g/l and very preferably from 0.75 to 2.5 g/l—calculated as 2-hydroxymethyl-2-nitro-1,3-propanediol.

Other advantageous refinements have already been explained above for the composition of the invention.

According to the method of the invention for phosphating metallic surfaces, the metallic surface after treatment with the composition of the invention is optionally rinsed and/or dried.

According to a first preferred embodiment, there may then follow an acidic, aqueous passivation, in particular one based on at least one titanium and/or zirconium compound and also optionally on at least one organosilane, the term "organosilane" being intended to encompass also the associated hydrolysis and condensation products, hence the corresponding organosilanols and organosiloxanes. As a result, especially on surfaces/surface regions made of/comprising aluminum, there is a further improvement in corrosion control (lower corrosive film undermining).

According to a second preferred embodiment, there may then alternatively follow a preferably alkaline, aqueous afterrinse based on at least one organosilane and/or on at least one other organic compound.

According to a further possible embodiment, the metallic surface already treated with an essentially nickel-free composition of the invention and also, optionally, rinsed and/or dried is treated with an aqueous afterrinse composition, more particularly with one comprising at least one kind of metal ion and/or at least one electrically conductive polymer, with "metal ion" referring either to a metal cation, a complex metal cation or a complex metal anion, preferably molybdate.

Lastly, there may also be cathodic electrocoating (CEC) or powder coating of the phosphate-coated and optionally passivated and/or afterrinsed metallic surface and also application of a paint system (powder or wet coating material).

The method of the invention may, though, also comprise further steps, in particular further rinsing or drying steps.

Other advantageous refinements of the method of the invention for phosphating metallic surfaces have already been explained earlier on above for the composition of the invention.

The phosphate-coated metallic surfaces produced by the method of the invention and optionally provided with a cathodic electrocoat and a paint system are used primarily in the sectors of automobile construction, of automotive components or of industry in general.

The phosphate coatings produced with the method of the invention may further serve as adhesion promoters for subsequent coating films, including as a forming aid beneath a subsequently applied lubricant layer for cold forming, or as corrosion control for a short storage time before painting.

In the text below, the intention is to illustrate the present invention by means of working examples, which should be understood as imposing no restriction, and comparative examples.

EXAMPLES

Test panels of various different metallic substrates (steel, electrolytically galvanized steel, hot-dip galvanized steel, and abraded aluminum) were first cleaned. This was done by dipping each panel into an alkaline (pH=10-11) aqueous solution comprising a surfactant plus a detergent builder comprising borate, silicate and phosphate.

The panels were then rinsed with mains water and subjected to alkaline (pH=8.5-10.5) aqueous activation based on titanium phosphate (PL1 to PL5) or zinc phosphate (PL6 and PL7).

Subsequent phosphating took place using acidic aqueous phosphating solutions numbered 1 to 7 (PL1 to PL7) as indicated in Tab. 1 (TN="trishydroxymethylnitromethane"=2-hydroxymethyl-2-nitro-1,3-propanediol, CN4=nitroguanidine; n.d.=not determined).

After phosphating, the panels were again rinsed with mains water.

The test panels treated with phosphating solutions 1 to 5 (PL1 to PL5) then further underwent an acidic (pH=4.3-4.4) aqueous passivation comprising hexafluorozirconic acid. The test panels treated with phosphating solutions 6 and 7 (PL6 and PL7), by contrast, were not passivated.

The panels were then rinsed with deionized water (conductivity <20 μS/cm) and dried in a drying oven at 110 to 120° C.

The different phosphated test panels analyzed using XRF (x-ray fluorescence analysis) gave the mean zinc phosphate coat weights set out in Tab. 2.

TABLE 1

| | PL1 | PL2 | PL3 | PL4 | PL5 | PL6 | PL7 |
|---|---|---|---|---|---|---|---|
| Accelerator | 1.5 g/l TN | 115 mg/l $NO_2^-$ | 1.5 g/l TN | 1.5 g/l TN + 10 mg/l $H_2O_2$ | 115 mg/l $NO_2^-$ | 1.5 g/l TN | 0.3 g/l CN4 |
| FA-KCl | n.d. | n.d. | 1.6 | 1.6 | 1.6 | 1.7 | 1.7 |
| FA (dil.) | 1.6 | 1.5 | 6.3 | 6.3 | 6.2 | 3.0 | 3.0 |
| TA-KCl | n.d. | n.d. | 24.0 | 23.8 | 23.9 | 23.5 | 24.3 |
| TA | 23.5 | 22.8 | n.d. | n.d. | n.d. | n.d. | n.d. |
| TAF | 17.9 | 17.4 | 17.7 | 17.5 | 17.7 | 17.0 | 18.0 |
| Zn (g/l) | 1.3 | 1.3 | 1.3 | 1.3 | 1.3 | 1.3 | 1.3 |
| Mn (g/l) | 1.0 | 1.0 | 1.0 | 1.0 | 1.0 | 1.0 | 1.0 |
| Ni (g/l) | 1.0 | 1.0 | 1.0 | 1.0 | 1.0 | 1.0 | 1.0 |
| P (g/l) | 5.7 | 5.7 | 5.6 | 5.6 | 5.7 | 5.5 | 5.7 |
| F (free) (mg/l) | 0 | 0 | 170 | 170 | 160 | 100 | 80 |
| $SiF_6^{2-}$ (g/l) | 0 | 0 | 1.3 | 1.3 | 1.3 | 0 | 0.2 |
| $BF_4^-$ (g/l) | 0 | 0 | 0 | 0 | 0 | 1.0 | 1.2 |
| Na (g/l) | 2.4 | 2.4 | 3.2 | 3.2 | 3.2 | 3.0 | 3.1 |
| T (° C.) | 53 | 53 | 53 | 53 | 53 | 53 | 53 |
| A value | 0.089 | 0.086 | 0.09 | 0.091 | 0.09 | 0.1 | 0.094 |

TABLE 2

| | Zinc phosphate coat weight ($g/m^2$)* | | | | | | |
|---|---|---|---|---|---|---|---|
| Substrate | PL1 | PL2 | PL3 | PL4 | PL5 | PL6 | PL7 |
| Steel | 3.0 | 3.1 | 2.2 | 2.1 | 2.0 | 2.9 | 2.0 |
| Hot-dip galvanized | 1.6 | 2.3 | 1.7 | 1.7 | 2.1 | 2.4 | 2.3 |
| Electrolytically galvanized | n.d. | n.d. | 2.4 | 2.4 | 2.3 | 2.2 | 2.3 |
| Aluminum | n.d. | n.d. | 2.9 | 2.4 | 2.6 | 2.3 | 2.1 |

*calculated as $Zn_3(PO_4)_2 \cdot 4H_2O$

Comparison of the inventive phosphating solution 1 (PL1) with the noninventive phosphating solution 2 (PL2) and of the inventive phosphating solutions 3 and 4 (PL3 and PL4) with the noninventive phosphating solution 5 (PL5) and of the inventive phosphating solution 6 (PL6) with the noninventive phosphating solution 7 (PL7) clearly shows that the method of the invention with TN—without or additionally with $H_2O_2$—as accelerator affords coat weights comparable with those obtained using nitrite or CN4 as accelerator.

Lastly, the test panels underwent cathodic electrocoating (CEC) using CathoGuard® 800 (BASF, Germany). Onto the electrocoat was then optionally applied a Mercedes Benz automobile finish system (MB) with the coat sequence of surfacer, basecoat and clearcoat.

The different painted test panels underwent a series of corrosion tests and film adhesion tests, the results of which are summarized in Tab. 3.

For the individual corrosion tests and film adhesion tests, the parameters set out in Tab. 4 were determined according to the standards indicated therein.

Comparison of the inventive phosphating solution 1 (PL1) with the noninventive phosphating solution 2 (PL2) and of the inventive phosphating solutions 3 and 4 (PL3 and PL4) with the noninventive phosphating solution 5 (PL5) and of the inventive phosphating solution 6 (PL6) with the noninventive phosphating solution 7 (PL7) clearly shows that the method of the invention with TN—without or additionally with $H_2O_2$—as accelerator affords corrosion control and film adhesion outcomes comparable with those obtained using nitrite or CN4 as accelerator.

TABLE 3

| Test | Coating | Substrate | PL1 | PL2 | PL3 | PL4 | PL5 | PL6 | PL7 |
|---|---|---|---|---|---|---|---|---|---|
| PV 1210, Var. 1 | CEC | Steel | 0.1 | 0.2 | 0.2 | 0.3 | 0.2 | 0.3 | 0.3 |
| PV 1210, Var. 2 | | | 1.0 | 1.0 | 1.3 | 1.0 | 1.3 | 1.5 | 1.5 |
| PV 3.15.3, Var. 1 | CEC | Electrol. galv. | 0.8 | 0.8 | 0.6 | 0.8 | 0.6 | 0.6 | 0.6 |
| | | Hot-dip galv. | n.d. | n.d. | 0.9 | 0.9 | 0.9 | 1.0 | 0.6 |
| PV 3.15.3, Var. 2 | | Electrol. galv. | 1.5 | 1.7 | 1.5 | 1.7 | 1.3 | 1.2 | 1.0 |
| | | Hot-dip galv. | n.d. | n.d. | 2.2 | 2.0 | 2.2 | 1.5 | 1.5 |

TABLE 3-continued

| Test | Coating | Substrate | PL1 | PL2 | PL3 | PL4 | PL5 | PL6 | PL7 |
|---|---|---|---|---|---|---|---|---|---|
| VDA 233-102, Var. 1 | CEC + MB | Steel | 0.8 | 0.9 | 0.9 | 1.0 | 1.0 | 3.2 | 3.4 |
| | | Electrol. galv. | 1.0 | 0.9 | 0.9 | 0.8 | 0.9 | 0.5 | 0.5 |
| | | Hot-dip galv. | n.d. | n.d. | 0.9 | 1.0 | 1.4 | 0.8 | 0.8 |
| VDA 233-102, Var. 2 | | Alumin. | n.d. | n.d. | 0.4 | 0.5 | 0.4 | 0.5 | 0.3 |
| VDA 233-102, Var. 3 | | Steel | 0.8 | 1.2 | 1.5 | 1.3 | 1.8 | n.d. | n.d. |
| | | Electrol. galv. | 2.0 | 1.5 | 1.8 | 1.5 | 1.5 | n.d. | n.d. |
| | | Hot-dip galv. | n.d. | n.d. | 1.0 | 0.8 | 1.0 | n.d. | n.d. |
| | | Alumin. | n.d. | n.d. | 1.8 | 0.8 | 1.8 | n.d. | n.d. |
| CASS, Var. 1 | CEC + MB | Alumin. | n.d. | n.d. | 0.3 | 0.3 | 0.3 | n.d. | n.d. |
| CASS, Var. 2 | | | n.d. | n.d. | 0.9 | 1.0 | 0.8 | 1.3 | 1.4 |
| CASS, Var. 3 | | | n.d. | n.d. | 2.0 | 2.2 | 2.1 | n.d. | n.d. |
| Outdoor weathering VDA 621-414, Var. 1 | CEC + MB | Steel | 2.5 | 3.4 | 3.8 | 3.8 | 3.7 | 2.7 | 3.8 |
| | | Electrol. galv. | 0.5 | 0.5 | 0.5 | 0.5 | 0.5 | 0.5 | 0.3 |
| | | Hot-dip galv. | n.d. | n.d. | 0.5 | 0.5 | 0.5 | 0.3 | 0.1 |
| Outdoor weathering VDA 621-414, Var. 2 | | Alumin. | n.d. | n.d. | 0.5 | 0.6 | 0.7 | 0.3 | 0.4 |
| Water condensation DIN EN ISO 6270-2 CH | CEC + MB | Steel | 1 | 1 | 0 | 0 | 0 | 0 | 1 |
| | | Electrol. galv. | 1 | 0 | 1 | 0 | 0 | 0 | 0 |
| | | Hot-dip galv. | n.d. | n.d. | 0 | 0 | 0 | 0 | 1 |
| | | Alumin. | n.d. | n.d. | 0 | 0 | 0 | 0 | 0 |

TABLE 4

| Test | Parameter |
|---|---|
| PV 1210, Var. 1 | Undermining d/mm/30 days/DIN EN ISO 4628-8 |
| PV 1210, Var. 2 | Stone chipping/30 days/DIN EN ISO 20567-1 |
| PV 3.15.3, Var. 1 | Undermining d/mm/360 h/DIN EN ISO 4628-8 |
| PV 3.15.3, Var. 2 | Stone chipping/360 h/DIN EN ISO 20567-1 |
| VDA 233-102, Var. 1 | Undermining d/mm/6 weeks/DIN EN ISO 4628-8 |
| VDA 233-102, Var. 2 | Filiform, mean value/mm/6 weeks/DIN EN ISO 4628-8 |
| VDA 233-102, Var. 3 | Stone chipping/6 weeks/DIN EN ISO 20567-1 |
| CASS, Var. 1 | Undermining d/mm/96 h/DIN EN ISO 4628-8 |
| CASS, Var. 2 | Undermining d/mm/240 h/DIN EN ISO 4628-8 |
| CASS, Var. 3 | Undermining d/mm/504 h/DIN EN ISO 4628-8 |
| Outdoor weathering VDA 621-414, Var. 1 | Undermining d/mm/12 months/DIN EN ISO 4628-8 |
| Outdoor weathering VDA 621-414, Var. 2 | Filiform, mean value/mm/12 months/DIN EN ISO 4628-8 |
| Water condensation DIN EN ISO 6270-2 CH | Cross-cut/240 h + 24 h (264 h)/DIN EN ISO 2409 |

The invention claimed is:

1. An acidic, aqueous composition for phosphating metallic surfaces, which comprises zinc ions, manganese ions, phosphate ions, at least one accelerator of a formula (I) below, $$R_1R_2R_3C—NO_2 \quad (I),$$

and optionally nickel ions, wherein each of the substituents $R_1$, $R_2$ and $R_3$ on the carbon atom is selected, independently of the others, from the group consisting of hydroxymethyl, 1-hydroxyethyl, 2-hydroxyethyl, 1-hydroxypropyl, 2-hydroxypropyl, 3-hydroxypropyl, 1-hydroxy-1-methylethyl and 2-hydroxy-1-methylethyl.

2. The composition according to claim 1, which comprises at least one accelerator of a formula (II) below $$[OH—(CH_2)_n—]_3C—NO_2 \quad (II)$$

wherein for each of the 3 $OH—(CH_2)_n—$ groups, independently of the others, n=1 to 3.

3. The composition according to claim 2, wherein the at least one accelerator of the formula (II) comprises at least one compound in which, for all 3 $OH—(CH_2)_n—$ groups, n=1 or n=2.

4. The composition according to claim 2, wherein the at least one accelerator of the formula (II) comprises 2-hydroxymethyl-2-nitro-1,3-propanediol.

5. The composition according to claim 1, wherein the at least one accelerator is present at a concentration in a range of from 0.25 to 4.0 g/l.

6. The composition according to claim 1, which comprises, besides the at least one accelerator, hydrogen peroxide ($H_2O_2$) as a further accelerator.

7. The composition according to claim 1, which comprises no deliberately added nitroguanidine.

8. The composition according to claim 1, which comprises a content of at least one complex fluoride.

9. The composition according to claim 1, which comprises a free fluoride content in a range of from 20 to 250 mg/l and a sodium content in a range of from 1.0 to 4.0 g/l.

10. The composition according to claim 1, for which FA or FA-KCl is in a range of from 0.3 to 2.0 points, FA (dil.) is in a range of from 0.5 to 8 points, FTA is in a range of from 10 to 28 points, TA or TA-KCl is in a range of from 12 to 45 points, the A value is in a range of from 0.01 to 0.2 and the temperature is in a range of from 30 to 58° C.

11. The composition according to claim 1, wherein the composition comprises nickel ions.

12. The composition according to claim 1, wherein the at least one accelerator is present at a concentration in a range of from 0.50 to 3.33 g/1.

13. The composition according to claim 1, which comprises a content of hexafluorosilicate and/or tetrafluoroborate.

14. A method for phosphating metallic surfaces, wherein a metallic surface, optionally after cleaning and/or activation, is treated with the composition according to claim 1 and thereafter optionally rinsed and/or dried.

15. The method according to claim 14, wherein the metallic surface is a surface that, besides regions made of zinc, also comprises regions made of aluminum and optionally regions made of iron.

16. The method according to claim 14, after which there is additionally an acidic, aqueous passivation.

17. The method according to claim 14, after which there is additionally an acidic, aqueous passivation based on at least one titanium and/or zirconium compound and also optionally on at least one organosilane, or an aqueous afterrinse based on at least one organosilane and/or on at least one other organic compound.

18. A method of using the phosphate coating produced with a method according to claim 14, the method comprising using the phosphate coating as an adhesion promoter for subsequent coating films, as a forming aid beneath a subsequently applied lubricant layer for cold forming, or as corrosion control for a short storage time before painting.

19. A method for producing a composition according to claim 1, which comprises i) first producing an aqueous additive which comprises 1 to 50 wt % of at least one accelerator of a formula (I) below wherein each of the substituents $R_1$, $R_2$ and $R_3$ on the carbon atom is selected, independently of the others, from the group consisting of hydroxymethyl, 1-hydroxyethyl, 2-hydroxyethyl, 1-hydroxypropyl, 2-hydroxypropyl, 3-hydroxypropyl, 1-hydroxy-1-methylethyl and 2-hydroxy-1-methylethyl, and ii) then adding this additive to a phosphating bath composition which comprises zinc ions, manganese ions, phosphate ions and, optionally, nickel ions, wherein the aqueous additive is produced by dissolving the at least one accelerator directly in water and not first producing a suspension using stabilizers.

20. The method according to claim 19, wherein the aqueous additive is produced by dissolving the at least one accelerator directly in water and not first producing a suspension using stabilizers and also not adding a biocide.

* * * * *